US006019250A

United States Patent [19]

Pozniak et al.

[11] Patent Number: 6,019,250

[45] Date of Patent: Feb. 1, 2000

[54] LIQUID DISPENSING APPARATUS AND METHOD

[75] Inventors: Peter M. Pozniak, San Jose; Benjamin R. Roberts, Los Altos, both of Calif.

[73] Assignee: The BOC Group, Inc., New Providence, N.J.

[21] Appl. No.: 08/950,150

[22] Filed: Oct. 14, 1997

[51] Int. Cl.[7] ..... B67B 7/00; B67D 5/08

[52] U.S. Cl. ..... 222/1

[58] Field of Search ..... 222/61, 71, 135, 222/136, 318, 399, 1

[56] References Cited

U.S. PATENT DOCUMENTS 5,417,346 5/1995 Ferri, Jr. et al. ..... 222/61

*Primary Examiner*—Gregory L. Huson
*Attorney, Agent, or Firm*—David M. Rosenblum; Salvatore P. Pace

[57] ABSTRACT

A liquid dispensing method and apparatus in which liquid is dispensed from chambers, that can be pressure vessels, to a flow circuit. A valve network is designed such that when one chamber functions in a dispense mode of operation another chamber functions in a return mode of operation in which unused liquid is sent back to such chamber so that liquid is continually circulated. The chamber or vessel undergoing the return mode of operation is vented through a valve that is either a pressure regulation valve having a set point of pressure or a remotely activated control valve response to liquid pressure at the point of use. In such manner internal pressure within the chamber or pressure vessel undergoing the return mode of operation is regulated to in turn regulate liquid pressure at the point of use. In case of pressure vessel operation, gas pressure within each pressure vessel can also be regulated in conjunction with internal pressure during the return mode to in turn regulate liquid pressure at the point of use. As a result of such pressure regulation, constant flow rate of liquid through the flow circuit and at the point or points of use can be assured.

20 Claims, 1 Drawing Sheet

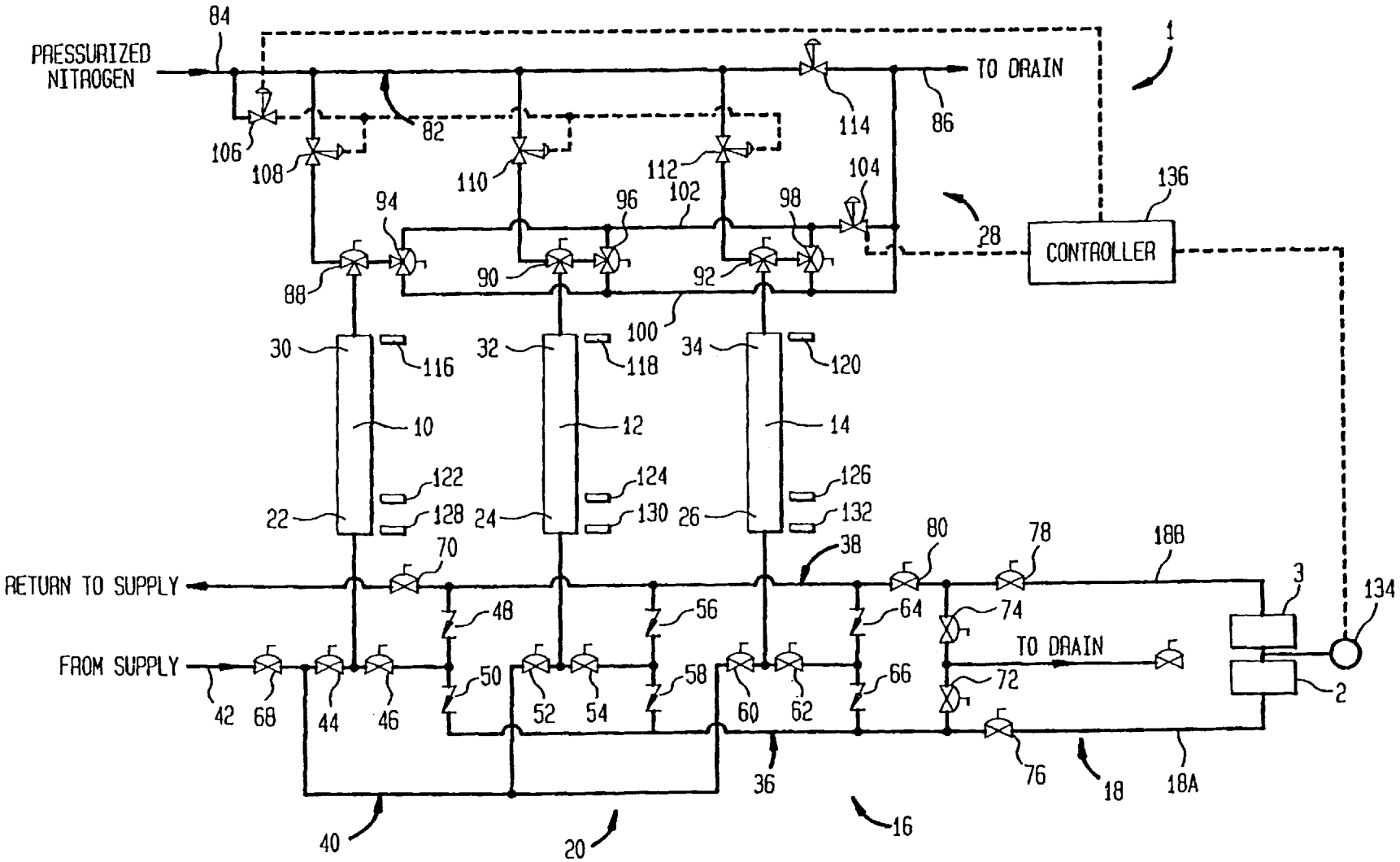
FIG.

LIQUID DISPENSING APPARATUS AND METHOD

BACKGROUND OF THE INVENTION

The present invention relates to an apparatus and method for dispensing a liquid to one or more points of use. More particularly, the present invention relates to such an apparatus and method involving subjecting each of a plurality of chambers to a cycle in which during a fill mode the chambers are filled with the liquid, during a dispense mode the liquid is driven from the chambers to the one or more points of use, and during a return mode unused liquid from the point or points of use is returned to the chambers. Even more particularly, the present invention relates to such an apparatus and method in which the cycle is conducted such that when one chamber is in the dispense mode, another chamber is in the return mode, thereby to allow for the continued circulation of the liquid.

The prior art has proved a number of systems for liquid dispensing that have particular application to the industrial dispensing of process chemicals. One major application of such apparatus is the semiconductor fabrication industry in which chemicals such as photoresist, slurries, and etc. are distributed to one or more points of use such as tools used in such fabrication. In the case of a slurry, the point of use can be a pump employed to feed a polishing tool used in chemical mechanical polishing or planarization.

Although pumps are used for liquid dispensing, it can be important, particularly in the case of semiconductor fabrication, that the chemical be distributed to the points of use without the type of pulsation in flow that can be caused by reciprocating pumping equipment. Such non-pulsating flow can be produced by using pressure vessels to conduct the dispensing. The pressure vessels used for such purpose are pressurized with a chemically non-reactive gas (with respect to the process being conducted) such as ultra-high purity nitrogen. For example, U.S. Pat. No. 5,417,346, has liquid being dispensed from three pressure vessels that are first evacuated to draw in liquid. Thereafter, the pressure vessels are pressurized with nitrogen to dispense the liquid.

In any dispensing system, problems can arise that are associated with the actual usage of the liquid to be dispensed, to wit: not all of the liquid to be dispensed will necessarily be used at the point of use. In order to solve this problem, as set forth in the patent mentioned above, recirculation pathways are provided to recirculate liquid back to a bulk source. The problem can be particularly troublesome in case of slurries because the particles that suspended particles will tend to settle out of the slurry if left stagnant. Additional usage related problems occur where several tools or point of use are fed by one dispensing system. When one or more are taken off-line or brought back on-line, the flow rate of liquid at each of the points of use will change. To this end, in U.S. Pat. No. 5,417,346, the flow rates at points of delivery are sensed to automatically trigger needle valves to assure constant flow conditions. Although not mentioned in the patent cited above, it is common to regulate the entire response of the dispensing system to changes in demand by way of regulating the pressure within the return lines that recirculate liquid back to the bulk sources through pressure regulation valves that regulate liquid pressure. The problem with using valves to assure constant flow conditions is that chemicals to be dispensed can be very corrosive and/or abrasive and as such, valves can act as points of potential wear and maintenance in the dispensing apparatus.

As will be discussed, the present invention provides an apparatus and method for dispensing liquids that incorporates a cyclic operation that inherently allows for continued circulation of the liquid and also, is particularly amenable to controlling flow conditions at the point or points of use without that use of valves that are in contact with the liquid to be dispensed.

SUMMARY OF THE INVENTION

The present invention provides an apparatus for dispensing liquid under impetus of gas pressure to at least one point of use. To this end, a plurality of chambers are provided, each having dispense, return and fill modes of operation in which liquid is driven therefrom, unused liquid is returned, and new liquid is introduced, respectively. A liquid distribution system is provided having a flow circuit connected to the at least one point of use to feed said liquid from the pressure vessels and to return said unused liquid from the at least one point of use. The liquid distribution system also has a valve network communicating between the chambers and said flow circuit. The valve network is configured such that two of the chambers can be brought into communication with one another, thereby to allow one of the two of said chambers to function in the dispense mode of operation and the other of the two chambers to function in the return mode of operation, receiving said unused liquid from the at least one point of use. Additionally, a means is provided for driving the liquid from each of said chambers into the liquid distribution system during the dispense mode of operation.

In another aspect, the present invention provides a method of dispensing liquid to at least one point of use. In accordance with the method each of a plurality of chambers is subjected to dispense, return and fill modes of operation in a cycle so that when a one of the chambers is in the dispense mode of operation, a further of the chambers is in the return modes of operation. Liquid is driven from each of the chambers during the dispense mode of operation to the at least one point of use and unused liquid is returned back to the further pressure vessel undergoing said return mode of operation. Each of the pressure vessels is filled with new liquid to be dispensed during the fill mode of operation.

Preferably, the apparatus and method of the present invention is conducted with three chambers so that the process is continuous. However, the present invention could be practiced with two chambers. In such case there might be a slight discontinuity of operation between the end of the return mode and the end of the fill mode or alternatively, there might be some overlap of the return and fill modes to allow for continuous operation. Furthermore, the present invention can be practiced in connection with any device having a chamber. For instance, although the present invention is described with reference to pressure vessels which function as chambers, it would have equal applicability to pumps having pumping chambers or cylinders to function as chambers. All of such possibilities are intended to be covered in the appended claims.

As is apparent from the above description, the present invention in a basic sense relates to an apparatus and method in which the dispensed liquid is circulated to the points of use and unused liquid is returned back to a chamber undergoing the return mode of operation. In such manner, liquid is subject to movement during the dispensing operation. As will become apparent, the present invention in other aspects relates to the fact that its basic cyclic operation of dispense, return, and fill modes of operation is particularly amenable to assuring constant flow conditions at the point or points of use by assuring a constant liquid pressure at the points of use. In case of pressure vessels this can be accomplished by regulating gas pressure in the pressure vessel subjected to the dispense mode and internal pressure of the pressure vessel subjected to the return mode. Other advantages and aspects of the present invention will of course become apparent from the drawings and detailed description.

BRIEF DESCRIPTION OF THE DRAWINGS

While the specification concludes with claims distinctly pointing out the subject matter that Applicants' regard as their invention, it is believed that the invention will be better understood when taken in connection with the accompanying drawings in which the sole figure is an apparatus for carrying out a method in accordance with the present invention.

DETAILED DESCRIPTION

With reference to the figure, an apparatus 1 in accordance with the present invention is illustrated. Apparatus 1 is designed to dispense chemical liquids such as slurries to points of use to 2 and 3 which in case of slurries could be a peristaltic pump to feed the liquid to a chemical mechanical polishing tool.

Apparatus 1 is provided with pressure vessels 10, 12 and 14. As will be discussed, each of pressure vessels 10, 12 and 14 is subjected to dispense, return and fill modes of operation. In the dispense mode, each of pressure vessels 10, 12 and 14 is pressurized to feed liquid to points of use 2 and 3. The liquid is distributed from each of pressure vessels 10, 12 and 14 through a liquid distribution system 16 having a flow circuit 18 connected to points of use 2 and 3 to feed liquid from pressure vessels 10, 12 and 14 to points of use 2 and 3 and to return unused liquid therefrom back to pressure vessels 10, 12 and 14. The unused liquid is then routed to a pressure vessel (10, 12, and 14) undergoing the return mode. Liquid distribution system 16 also has valve network 20 to control the flow of liquid to and from bottom regions 22, 24 and 26 of pressure vessels 10, 12 and 14, respectively. Although not illustrated, all liquid piping should incorporate smooth radius bends so as to prevent shearing of liquids such as slurries. Pressure piping system 28 provides communication between a pressure source (not illustrated but as could be appreciated by those skilled in the art, vaporized liquid nitrogen) and the top regions 30, 32 and 34 of pressure vessels 10, 12 and 14, respectively.

As will be discussed, liquid pressure within flow circuit 18 is sensed and the pressure within the pressure vessels as they undergo dispense and return modes is adjusted to control liquid pressure so that it remains substantially constant. This pressure control will ensure that the flow rate of liquid to each of the points of use 2 and 3 remains constant.

Flow circuit 18 has dispense legs 18A and return legs 18B to send liquid to points of use 2 and 3 and to return liquid from points of use 2 and 3 back to valve network 20. It is to be noted that although only two points of use 2 and 3 are illustrated, the present invention has applicability to any number of points of use. It is to be noted that the present invention would even have applicability to a single point of use and would be particularly advantageous where the single point of use was used intermittently.

Valve network 20 is designed such that when each of the pressure vessels is in the dispense mode, at least a further of the pressure vessels is in a return mode receiving the unused liquid from points of use 2 and 3. To this end, valve network 20 includes distribution manifold 36 from which liquid is distributed to dispense leg 18A and a return manifold 38 to which unused liquid returns from return leg 18B. A supply manifold 40 is provided having an inlet 42 which can be connected to a bulk source of liquid to be dispensed. Although not illustrated, any means can be used for transfer from a bulk source to inlet 42. For instance, a pump, gravity, or vacuum could be used with no particular means being preferred.

Valve network 20 is provided with groups of cut-off and check valves to control flow of liquid during the various modes of operation of pressure vessels 10, 12, and 14. The cut-off valves have open and closed positions to allow and to cut-off the flow of liquid, respectively. The check valves allow flow in only one direction. Specifically, first and second cut-off valves 44 and 46 and a set of two check valves 48 and 50 are associated with the operation of pressure vessel 10, first and second cut-off valves 52 and 54 and check valves 56 and 58 are associated with the operation of pressure vessel 12 and first and second cut-off valves 60 and 62 and two check valves 64 and 66 are associated with the operation of pressure vessel 14. Note that the two check valves (48, 50, 56, 58, 61, 66) arc oriented to permit liquid only flow from return manifold 38 or to distribution manifold 36.

Thus, assuming pressure vessel 10 is in a dispense mode, first cut-off valve 44 will be set in the closed position and second cut-off valve 46 will be set in the open position. This will allow liquid to be driven from pressure vessel 10 to distribution manifold 36 and then to dispense leg 18A of flow circuit 18. When pressure vessel 12 is in the dispense mode, first cut-off valve 52 will be set in the closed position and second cut-off valve 54 will be set in the open position. Similarly, when pressure vessel 14 is in the dispense mode, first cut-off valve 60 will be set in the closed position and second cut-off valve will be set in the open position.

At the time pressure vessel 10 is functioning in the dispense mode, pressure vessel 12 will be functioning in the return mode. To this end, its first cut-off valve 52 is set in the closed position and second cut-off valve 54 is open position. Unused liquid will flow back through return leg 18B of flow circuit 18 to return manifold 38 and then through check valve 56 and second cut-off valve 54 back into bottom region 24 of pressure vessel 12. Thus, the cut-off valve setting for pressure vessel 12 in the return mode will be the same as in the dispense mode. The same valve settings will hold true for first and second cut-off valves 44 and 46 when pressure vessel 10 is in the return mode and for first and second cut-off valves when pressure vessel 14 is in the return mode. As will be discussed, the flow direction is established through venting of the pressure vessel (10, 12, or 14) undergoing the return mode at a lower pressure then the pressurization pressure of the pressure vessel (10, 12, or 14) undergoing the dispense mode. The check valve pairs 48,50, 56,58 and 64,66 prevent back flow of pressurized liquid flowing from distribution manifold 36 to the return manifold 38.

When pressure vessel 10 is in the dispense mode and pressure vessel 12 is in the return mode, pressure vessel 14 will be in the fill mode. To this end, first cut-off valve 60 is set in the open position and second cut-off valve 62 is set in the closed position. Liquid enters inlet 42 from the bulk source, flows into supply manifold 40, and then into bottom region 26 of pressure vessel 14. When pressure vessel 10 is in the fill mode, first cut-off valve 44 will be set in the open position and second cut-off valve 46 will be set in the closed position and when pressure vessel 12 is in the fill mode first cut-off valve 52 will be set in the open position and second cut-off valve 54 will be set in the closed position.

After a pressure vessel (10, 12, or 14) is in the dispense mode, it will function in the return mode and then the fill mode. However, it is preferable that the switching between modes not be instantaneous and as such, at any one time, two of pressure vessels 10, 12, or 14 will function in the dispense mode for a short interval. These two pressure vessels will be those that have respectively completed the fill mode and that have been acting in the dispense mode. After such simultaneous dispense mode operation, the pressure vessel, of the two pressure vessels that has most recently completed the fill mode, will continue to function in the dispense mode and the other pressure vessel will next function in the return mode. During this time, a third of the pressure vessels 10, 12, or 14 that had been functioning in the return mode will also simultaneously so function and then switch into the fill mode. These blending of modes acts to prevent pressure pulsations from occurring within flow circuit 18. As will be discussed, the triggering of the modes is controlled by liquid level detection.

Valve network 20 is also provided with a cut-off valve 68 to cut-off the flow from a bulk supply. Also, a cut-off valve 70 is provided. During normal operation, cut-off valve 70 is set in the closed position. When set in the open position, liquid is allowed to recirculate back to the bulk supply. Cut-off valves 72 and 74 permit draining of distribution manifold 36 and return manifold 38. During such draining, cut-off valves 76 and 78 isolate flow circuit 18. A cut-off valve 80 is provided to allow liquid to return from flow circuit 18 back to drain.

Pressure is supplied from a source of pressurized gas which is non-reactive with the chemical to be dispensed. In the semiconductor processing industry pressurized ultra-high purity nitrogen is commonly used for such purpose. Pressure vessel piping system 28 includes a pressure manifold 82 having an inlet 84 for connection to the source of gas pressure and a vent outlet 86 which is normally vented to drain in case corrosive chemicals are present in the vent gas. Pressurization of pressure vessels 10, 12 and 14 during the dispense mode is controlled by first three-way valves 88, 90 and 92 which are connected between pressure manifold 82 and pressure vessels 10, 12 and 14, respectively. Second three-way valves 94, 96 and 98 are connected to first three-way valves 88, 90, and 92, respectively, to control venting during return and fill modes of operation. Each of the aforementioned three-way valves (88–98 inclusive) have two positions so that flow may be established between two valve ports.

When each of first three-way valves 88, 90 or 92, is set in a first of the two positions, flow communication is established between pressure manifold 82 and the respective connected pressure vessel 10, 12 or 14 to establish the dispense mode. Thus, when first three-way valve 88 is set in the first of the two positions, high pressure nitrogen flows into pressure vessel 10 which is thus, in the dispense mode of operation.

When each of first three-way valves 88, 90, or 92 is set in the second of their two positions, communication is established between top regions 30, 32 and 34 of pressure vessels 10, 12 and 14 and second three-way valves 94, 96 and 98. This second setting of first three-way valves 88, 90, or 92 occurs during fill and return modes of operation.

When three-way valves 94, 96 and 98 are set in their first and second of two positions (first three-way valves 88, 90, or 92 having been set in the second of their two positions,) flow communication is established between top regions 30, 32, and 34 of pressure vessels 10, 12, and 14 and either flow path 100 or flow path 102. When second three-way valves are set in the position involving flow path 100, pressure vessels 10, 12 and 14 simply vent to drain which is at atmospheric pressure. This allows filling of a pressure vessel (10, 12, or 14) during the fill mode. For example if pressure vessel 14 is in the fill mode, first three-way valve 92 would be set in the second of its positions and second three-way valve 98 would be set in its position to allow flow communication with flow path 100. It is understood that in such case pressure vessel 12 would be undergoing the return mode and as such, second three-way valve 96 would be set in the opposite of positions to allow flow communication with flow path 102. Flow path 102 has a pressure regulation valve 104 through which gas vents through the return mode. Pressure regulation valve 104 is a control valve controlled to operate at a lower pressure than the gas pressure so that liquid is driven through flow circuit 18 and also to regulate pressure within the pressure vessel undergoing the return mode of operation.

Pressure is regulated in each pressure vessel 10, 12 and 14 (during the dispense mode of operation ) by means of a pilot regulator 106 another control valve that controls the pressure of slaved pressure re regulators 108, 110 an d 112 located downstream of pilot regulator 106. This prevents pressure fluctuations that would otherwise occur within pressure vessels 10, 12, or 14 during switching pressure vessels between dispense, return, and fill modes of operation. Although less advantageous, a single pressure regulator 106 could be employed without slaved pressure regulators 18, 110 and 112. Further, it is to be noted that a pressure relief valve 114 is provided as a safety device to prevent failure of pressure vessel piping system 28 should a malfunction occur.

As could be appreciated, the above means for delivering gas pressure to the pressure vessels, although preferred, is one of many different valve arrangements. For instance two position valves with separates lines leading to and from the pressure vessels could be provided for delivery of gas pressure to the vessels and subsequent venting of the vessels.

Although not illustrated, but as would be known to those skilled in the art, all of the aforementioned valves which operate as cut-off valves and three-way valves can be controlled by a programmable logic controller or perhaps an analog device. Such circuit or device and the electrical connections would be known to those skilled in the art and are thus, not illustrated. However, the activation of such circuits or devices would be controlled by high liquid level detectors 116, 118 and 120 and first and second lower level liquid detectors 122, 124, 126 and 128, 130, 132, respectively. Each of level detectors 116–132, inclusive, could be either ultrasonic, point level detectors, or mechanical devices.

By way of example, assuming, pressure vessel 10 is in a dispense mode of operation, when the level of the liquid is detected by first lower level sensor 122, pressure vessel 14 (which has just been filled with liquid) is triggered to pressurize and thus, first three-way valve 92 is set in a position to establish flow communication between pressure manifold 82 and top region 34 of pressure vessel 14. After a slight delay, cut-off valve 62 opens and both pressure vessels 10 and 14 now function in the dispense mode. Pressure vessel 12 is functioning in the return mode. When the liquid level in pressure vessel 10 drops and is sensed by second lower level detector 128, first and second three-way valves 88 and 94 are set so that pressure vessel 10 now vents through flow path 102. As such, pressure vessel 10 functions in the return mode of operation with pressure vessel 12. During this time, unused liquid backfills pressure vessel 10 and 12. When the level of liquid sensed within pressure vessel 10 rises and is sensed by first lower level detector 122, valve 52 is triggered into its open position and cut-off valve 54 re-sets into its closed position so that pressure vessel 12 undergoes the fill mode of operation and fills with liquid until the liquid level is sensed by high level detector 118. At the same time first and second three-way valves 90 and 96 are set to allow atmospheric pressure venting through flow path 100. When the high level is sensed by level detector 118, valve 52 is reset into its closed position. During the next cycle of operation, pressure vessel 12 will act in the dispense mode while pressure vessel 10 transitions from return to fill mode and pressure vessel 14 transitions between dispense and return mode. As mentioned above, such blending of modes is preferable to instantaneous switching that can cause some degree of pressure pulsation within flow circuit 18.

In order to control pressure and therefore liquid flow at the points of use, liquid pressure is sensed within flow circuit 18 by a pressure transducer 134. Its central placement will thus ensure constant pressure (which can result in constant flow) at both points of use 2 and 3. The output of pressure transducer 134 is fed as an input to a controller 136 which in turn acts to adjust pilot regulator 106 and pressure regulation valve 104, which are remotely activated control valves to control gas pressure in the pressure vessel undergoing the dispense mode and the internal pressure vessel undergoing the return mode so that the liquid pressure as sensed by pressure transducer 134 remains substantially constant within the limits of system response. Controller 136 is programmed so that as liquid pressure drops, pilot regulator 106 opens to increase pressure and vice-versa. Additionally, pressure regulation valve 104 is then adjusted to maintain a lower pressure within the pressure vessel undergoing the return mode and also, a liquid pressure as sensed by pressure transducer 134 constant. This is accomplished by programming controller 136 to maintain the liquid pressure constant and to appropriately adjust pilot regulator 106 and pressure regulation valve 104 in accordance with their flow characteristics.

An alternative, but less preferred means to regulate gas pressure and internal pressure and thereby to control liquid flow at the points of use is to employ mechanically adjusted valves for pilot regulator 106 and pressure regulation valve 104. Such mechanically adjusted valves are provided with settings to maintain constant gas pressure and constant internal pressure. The disadvantage of such means is that it will not maintain liquid pressure and therefore flow as precisely as an electronic system responding to liquid pressure at the points of use.

As could be appreciated by those skilled in the art, pressure regulation valve 104 could be a mechanical device designed to maintain a constant pressure in the vessel undergoing the return mode. In such case only pilot regulator 106 would be adjusted by controller 136 in response to liquid pressure variation. Similarly, Pilot regulator 106 could be the mechanical device which only pressure regulation valve 104 were operated by controller 136 in response to liquid pressure change. In any embodiment, however, pressure regulation valve 104 must operate to maintain a pressure difference between the gas pressure and the gas being vented during return mode operation to drive liquid through flow circuit 18.

In such manner as outlined above, potentially corrosive and/or abrasive liquid never comes in contact with control valves operating to maintain constant liquid pressure.

As could be appreciated by those skilled in the art, although only three pressure vessels are illustrated, more than three pressure vessels could be used in an embodiment of the present invention. For instance, a forth pressure vessel might always be filled and pressurized in case of a system breakdown. As indicated above, a minimum of two chambers or pressure vessels are necessary to carry out the present invention.

While the invention has been described with reference to preferred embodiments, it will occur to those skilled in the art, numerous changes, additions and omissions may be made without departing from the spirit and scope of the present invention.

We claim:

1. An apparatus for dispensing a liquid to at least one point of use, said apparatus comprising:

a plurality of chambers, each having dispense, return and fill modes of operation in which liquid is driven therefrom, unused liquid is returned, and new liquid is introduced, respectively;

a liquid distribution system having a flow circuit connected to said at least one point of use to feed said liquid from said chambers and to return said unused liquid from said at least one point of use, said liquid distribution system also having a valve network communicating between said chambers and said flow circuit;

said valve network configured such that two of said chambers can be brought into communication with one another, thereby to allow one of the two of said chambers to function in the dispense mode of operation and the other of the two chambers to function in the return mode of operation, receiving said unused liquid from said at least one point of use; and means for driving said liquid from each of said chambers into said liquid distribution system during said dispense mode of operation.

2. The apparatus of claim 1, wherein:

said chambers comprise pressure vessels; and said liquid driving means includes pressurization means for selectively providing communication between a pressure source and each of said vessels to pressurize said vessels with gas pressure during said dispense mode.

3. The apparatus of claim 2, further comprising regulation means for regulating gas pressure and internal pressure within each of said pressure vessels when functioningin said dispense a nd return mode of operations so that liquid pressure at said at least one point of u se remains substantially constant.

4. The apparatus of claim 3, wherein said regulation means comprises:

remotely operated control valves positioned to control the gas pressure and said internal pressure within said pressure vessels during said dispense and return modes of operation;

a pressure transducer located within said flow circuit to sense the liquid pressure; and a controller response to said pressure transducer and configured to operate said control valves so that liquid pressure remains substantially constant.

5. The apparatus of claim 3, wherein said pressure means is also configured to vent said vessels during said fill and return modes of operation and has two flow paths, one of the two flow paths activated during the fill mode of operation and venting to atmospheric pressure and the other of the two flow paths activated during the return mode of operation and associated with said regulation means so that said internal pressure of each of said pressure vessels functioning in the return mode is regulated through said other of the two flow paths.

6. The dispensing apparatus of claim 1, wherein said liquid distribution system also has an inlet and said valve network is also configured to selectively provide communication between said pressure vessels and said inlet during the fill mode of operation.

7. The dispensing apparatus of claim 4, wherein said pressure means includes:

a pressure manifold having an inlet for connection to said source of said gas pressure, one of said control valves to regulate said gas pressure and a vent outlet;

two flow path s to said vent outlet, one of the two flow paths venting to atmospheric pressure and the other of the two flow paths having another of said control valves to regulate said internal pressure; and first three-way valves connected to said pressure manifold and said pressure vessels and second three-way valves connected to said first three-way valves and said two flow paths;

each of said first and second three-way valves configured with two positions such that when said first three-way valves are set in a first of the two positions communication is established between said pressure manifold and said pressure vessels and when set in a second of the two positions communication is established between said pressure vessels and said second three-way valves and such that when said second three-way valves are set in the first and the second of the two positions, communication is established between said one and the other of the two flow paths, respectively, to vent to atmospheric pressure and through said regulation means.

8. The liquid distribution system of claim 1 or claim 7, wherein said valve network comprises:

a distribution manifold;

a return manifold;

an inlet manifold having said inlet; and for each of said pressure vessels, first and second cut-off valves connected thereto and a set of two check valves connecting said second cut-off valve to said distribution and return manifolds, said first cut-off valve connected to said inlet manifold so that liquid fills each of said pressure vessels when set in an open position, the second cut-off valve interposed between said pressure vessels and said set of two check valves and said two check valves oriented to permit said liquid flow from said return manifold to said second cut-off valve and from said second cut-off valve to said distribution manifold so that when said second cut-off valve is set in its open position, liquid can either flow from each of said pressure vessels to said distribution manifold during the dispense mode or flow from said return manifold back to said pressure vessels during the return mode.

9. The distribution system of claim 1, further comprising liquid level sensors connected to said pressure vessels to trigger said dispense, return, and fill modes of operation.

10. The distribution system of claim 2, wherein said plurality of said pressure vessels consists of three of said pressure vessels.

11. A method of dispensing liquid to at least one point of use comprising:

subjecting each of a plurality of chambers to dispense, return and fill modes of operation in a cycle so that when a one of chambers is in the dispense mode of operation, a further of said chambers is in the return modes of operation;

driving said liquid from each of said chambers during said dispense mode of operation to said at least one point of use;

returning unused liquid back to said further of said chambers undergoing said return mode of operation; and filling each of said pressure vessels with new liquid to be dispensed during the fill mode of operation.

12. The method of claim 11, wherein each of said chambers are pressure vessels and said pressure vessels are pressurized with gas pressure during the dispense mode to drive the liquid from each of the pressure vessels.

13. The method of claim 12, comprising regulating said gas pressure and internal pressure within each of said pressure vessels during said return mode of operation so that liquid pressure at said at least one point of use remains substantially constant.

14. The method of claim 13, further comprising:

sensing the liquid pressure within said flow circuit; and regulating said gas and internal pressures in response to the sensing of the liquid pressure.

15. The method of claim 11, wherein:

high, first and second lower levels of said liquid are sensed within each of said chambers, the second lower level being located below the first lower level;

when said first lower level of said liquid is sensed within said one chamber, a yet further chamber that has completed said fill mode of operation is also subjected to the dispense mode of operation so that said one and said yet further chamber are simultaneously subjected to said dispense mode of operation;

when said second lower level of said liquid is sensed within said one chamber, said one and said further chambers are simultaneously subjected to said return mode of operation;

when said first lower level of said liquid is again sensed within said one chamber, due to said one pressure vessel being subjected to the return mode of operation and unused liquid being returned thereto, said further chamber is subjected to said fill mode of operation and is filled with liquid until said high level of said liquid is sensed therein.

16. The method of claim 15, wherein each of said chambers are pressure vessels and said pressure vessels are pressurized with gas pressure during the dispense mode to drive the liquid from each of the pressure vessels.

17. The method of claim 16, comprising regulating said gas pressure and internal pressure within each of said pressure vessels during said return mode of operation so that liquid pressure at said at least one point of use remains substantially constant.

18. The method of claim 17, further comprising:

sensing the liquid pressure within said flow circuit; and regulating said gas and internal pressures in response to the sensing of the liquid pressure.

19. The method of claim 18, wherein each of said pressure vessels is pressurized with nitrogen.

20. The method of claim 11 or claim 19, wherein said liquid is a slurry and said point of use includes a tool used in chemical mechanical polishing.

* * * * *